US005220933A

United States Patent [19]

Albers

[11] Patent Number: 5,220,933

[45] Date of Patent: Jun. 22, 1993

[54] CLEANING TANK

[76] Inventor: Terry A. Albers, 22 Chicory Bend Ct., Sacramento, Calif. 95831

[21] Appl. No.: 804,094

[22] Filed: Dec. 6, 1991

[51] Int. Cl.[5] ..... B08B 3/02

[52] U.S. Cl. ..... 134/58 R; 134/170; 134/191; 134/199; 134/200

[58] Field of Search ..... 134/111, 170, 188, 191, 134/192, 199, 200, 58 R, 102.2, 138, 140, 141, 148, 151, 153

[56] References Cited

U.S. PATENT DOCUMENTS

| | | | |
|---|---|---|---|
| 2,154,559 | 4/1939 | Bilde | 134/188 X |
| 2,471,506 | 5/1949 | Wiswall | 134/199 X |
| 2,520,354 | 8/1950 | Zinty | 134/141 X |
| 2,652,844 | 9/1953 | Van Hise | 134/188 |
| 2,786,000 | 3/1957 | Roach | 134/21 |
| 3,020,917 | 2/1962 | Lyman | 134/111 X |
| 3,076,468 | 9/1963 | Belt | 134/102.1 |
| 3,078,861 | 2/1963 | Miller | 134/170 X |
| 3,203,437 | 8/1965 | Faust | 134/170 X |
| 3,707,404 | 12/1972 | Carlson | 134/109 X |
| 3,771,539 | 11/1973 | DeSantis | 134/111 |
| 3,890,988 | 6/1975 | Lee | 134/111 |
| 3,904,431 | 9/1975 | Dinerman | 134/171 X |
| 4,025,363 | 5/1977 | DeSantis | 134/111 X |
| 4,056,114 | 11/1977 | Boutillette | 134/200 X |
| 4,133,340 | 1/1979 | Ballard | 134/200 X |
| 4,509,545 | 4/1985 | Trotter | 134/199 |
| 4,552,728 | 11/1985 | Taylor | 134/200 X |
| 4,768,533 | 9/1988 | Hall | 134/200 X |
| 4,785,836 | 11/1988 | Yamamoto | 134/200 X |
| 4,793,369 | 12/1988 | Robb et al. | 134/170 |
| 4,960,142 | 10/1990 | Robb et al. | 134/138 |
| 4,995,409 | 2/1991 | Watts | 134/111 X |
| 5,107,876 | 4/1992 | Ozyjiwsky | 134/200 X |

FOREIGN PATENT DOCUMENTS 1293909 7/1987 Canada .

OTHER PUBLICATIONS

Cascade, The Automatic Spray Gun Cleaning System, by Uni-ram Products of Markham, Ontario, Canada (publication date unknown).

Power Master Power Spray Gun Cleaner Recycler, by Solv-X of Winnepeg, Manitoba, Canada (publication date unknown).

GWR Gun Washer and Recycler, by Herkules Equipment Corp. of Walled Lake, Mich. (publication date unknown).

*Primary Examiner*—Philip R. Coe

*Attorney, Agent, or Firm*—Joseph E. Gerber

[57] ABSTRACT

A cleaning tank comprised of a fluid container, an air-driven motor, a drive shaft, a filtered submersible pump, fluid transport conduits and outlet nozzles is disclosed. Supports are provided for workpieces to be cleaned.

79 Claims, 3 Drawing Sheets

CLEANING TANK

BACKGROUND OF THE INVENTION

1. Field of the Invention

The present invention relates generally to cleaning apparatus, and more specifically to apparatus for treating a soiled workpiece with cleaning solution. Further, the inventive apparatus herein is found to have particular utility in the auto body repair industry for the purpose of cleaning paint spray guns and related accoutrements.

2. Description of the Related Art

In many industries, tools, equipment and other workpieces need to be quickly and thoroughly cleaned. If cleaning is done by hand it is a messy and laborious process, and may expose those conducting the cleaning, and others, to harmful chemical solvents. Thus, cleaning tanks are used for many cleaning applications. Of the most convenient are those cleaning tanks having a pump and nozzles for directing a pressurized spray of cleaning solution at the workpiece.

Such cleaning tanks are used, for example, in the auto body repair industry, these being adapted to clean paint-laden equipment. However, the conventional constructions of such tanks leave much to be desired. One problem faced in designing cleaning tanks for that industry is that the solvents used, such as paint thinner and the like, create a flammable environment. Thus, air-driven pumps, rather than electrical pumps, are employed to drive solvent through conduits to nozzles aimed at workpieces such as spray gun parts. Such pumps are commonly of the reciprocating variety and are mounted on the outside wall of the solvent tank. These reciprocating pumps cause many problems when so used. For example, their reciprocating action causes these pumps to send considerable vibration throughout the system to which they are attached. This vibration tends, in time, to loosen the pump's mounting hardware, as well as other fittings and structures throughout the cleaning tank system, thereby causing leaks and other failures. These pumps also tend to be somewhat noisy.

Leakage of the pumps themselves is also a problem. These reciprocating pumps operate at fairly close tolerances, so the hard beads of paint that build up in a typical auto body shop cleaning tank system eventually cause the pump to leak and fail. Leaks pose many dangers to workers, these including fire hazards, harmful vapors and solvent burns. Further, leaking solvent creates a general environmental hazard and is likely to constitute a legal violation that invites citation.

Cleaning tanks in current use also commonly include structures such as drain cocks or other fittings in the walls and bottom of the tank where solvent is contained. No matter how well sealed, these structures and fittings are sites of potential leakage—especially when they are continually vibrated by the action of an adjacent reciprocating pump. Avoidance of these problems inherent in conventional designs adds considerable expense to their manufacture.

Thus, it appears that a need exists for a cleaning tank having a reliable, pneumatically-driven pump which poses no risk of solvent leakage to the environment, is quiet in its operation and is relatively inexpensive to manufacture.

SUMMARY OF THE INVENTION

The cleaning tank of the present invention is adapted to overcome the above-noted shortcomings and to fulfill the stated needs. In its essence, the invention comprises a fluid container having a submersible pump therewithin; means for driving the pump; outlet means within the fluid container for directing fluid at a workpiece; and, conduit means disposed between, and in fluid communication with, the pump and the outlet means for directing fluid to the outlet means.

The pump of the preferred embodiment of this cleaning tank is a gear-type rotary pump and is driven by a rotary air motor located within the tank's fluid container. Thus, noise in operation of the apparatus is minimal when compared with systems employing reciprocating mechanisms.

A barrel, or similarly-shaped structure is employed as the tank's fluid container, this yielding substantial savings in manufacturing costs over custom-shaped containers normally used in cleaning tank construction.

The motor, pump and conduit system all depend from hooks near the upper rim of the container, and are exceedingly easy to lift out for cleaning or service. This design also assures that any leak or failure of the pump or conduit system returns the leaked fluid to the tank, rather than permitting dangerous leaks to the outside.

This combination of elements yields an apparatus which is virtually leak-free, durable, easily serviceable and relatively quiet in its operation. When its conduits and outlets are configured to accommodate the cleaning of the insides as well as the outsides of specific types of workpieces, the apparatus is automatic in its operation, thus requiring no additional manual cleaning of the workpiece beyond that accomplished during a normal cleaning cycle.

Thus, objects, features and advantages of the present invention are to provide a cleaning tank that is leak-free, durable, easily serviceable, relatively quiet, versatile and inexpensive to manufacture.

Still further objects, features and advantages of the inventive cleaning tank disclosed herein will be apparent from the drawings and following detailed description thereof.

DESCRIPTION OF THE PREFERRED EMBODIMENT

Figure 1:
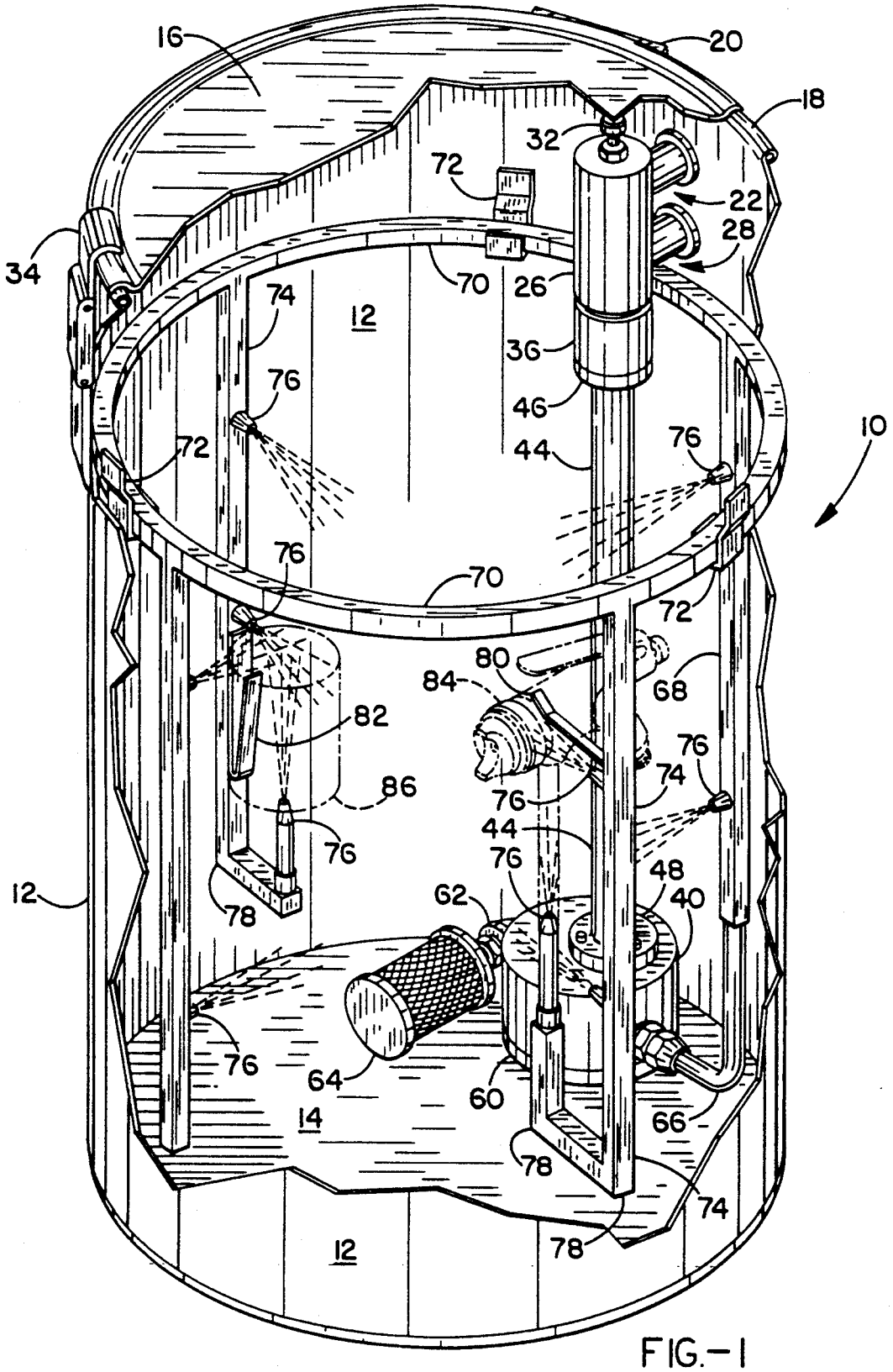
FIG. 1 is a cut-away perspective view of the cleaning tank of the present invention.

Referring now specifically to the drawings, FIG.1 shows the cleaning tank of the present invention, which is generally identified herein with reference numeral 10. A steel barrel has been used with success in constructing cleaning tank 10, although one skilled in the art may adapt almost any sturdy fluid container in accordance with the teachings herein for successful practice of the invention. Thus, it is to be understood that the following disclosure presumes the use of a cylindrical fluid container, but the configuration of the invention's elements may be altered to accommodate containers of differing shapes Cleaning tank 10 has a cylindrical side wall 12 to which circular tank bottom 14 is integrally bound. Tank lid 16 is circular and affixed to the upper rim 18 of tank 10 with hinge 20. Thus, upper rim 18 defines an opening in tank 10 for which lid 16 acts as a closure. A seal (not shown) may be provided between lid 16 and upper rim 18, as needed.

Figure 2:
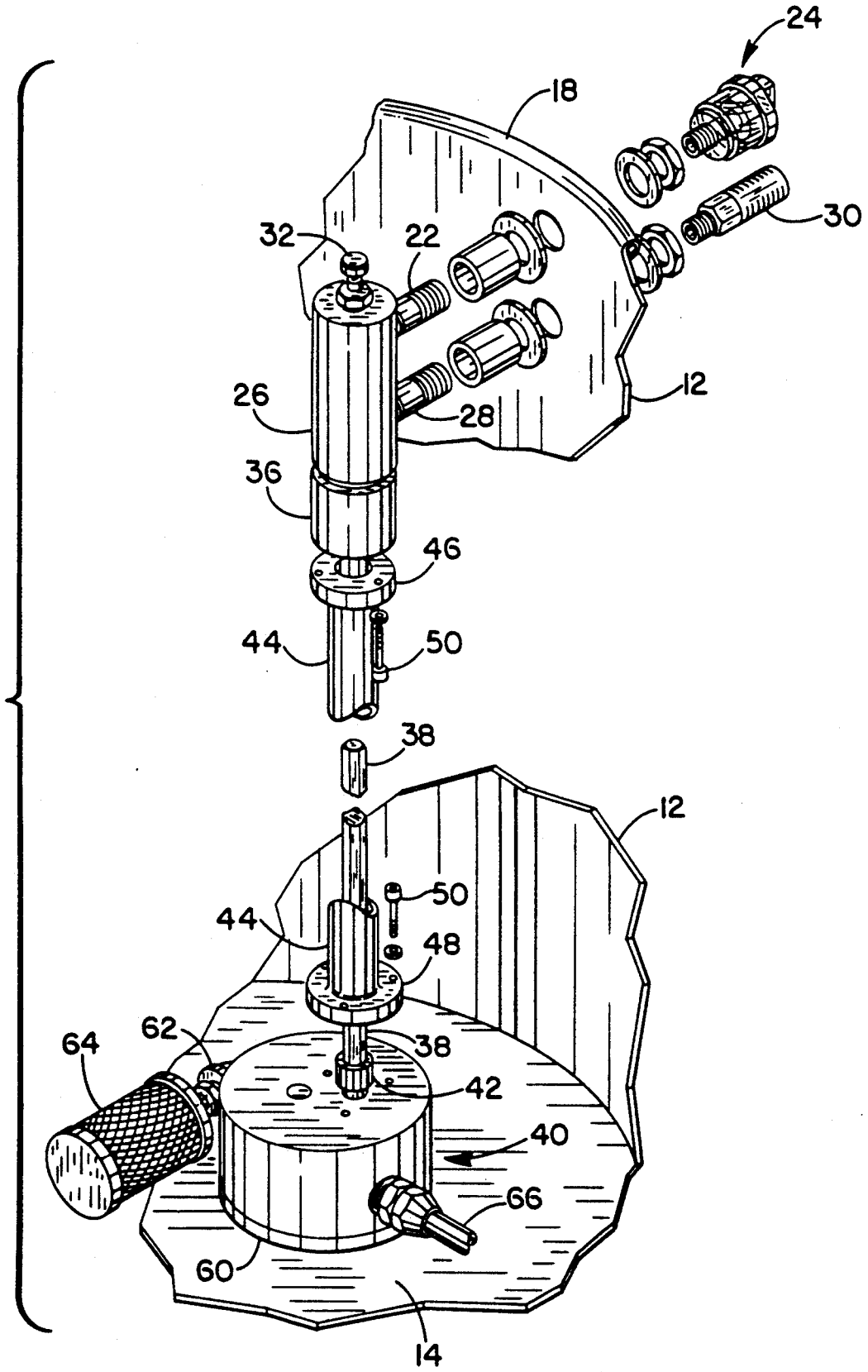
FIG. 2 is an enlarged fragmentary perspective of the drive and pump mechanisms of the cleaning tank of FIG. 1.

As shown in both FIGS. 1 and 2, adjacent upper rim 18 and slightly therebelow, air input 22 passes through side wall 12 and is affixed thereto with appropriate hardware (unnumbered). Air input 22 is connected via air conduit 24 to a source of pressurized air (not shown) which acts as a power supply. Air input 22 is in sealed pneumatic communication with air motor 26, and with air conduit 24, as well. Air outlet 28 is also in sealed pneumatic communication with air motor 26; it passes through side wall 12 and is affixed thereto with appropriate hardware (unnumbered). Muffler 30 is affixed in downstream relation to air outlet 28. One skilled in the art will be able to identify the construction, placement and composition of seals necessary to make these pneumatic mechanisms leak-free. The air input and output support the air motor on tank 10's side wall.

Air motor 28 may be of any conventional construction, many types of air motors already being well-known in the pneumatic tool arts. However, it should be noted that rotary motor constructions are preferred for their smooth operation, over motors employing reciprocating mechanisms.

Air motor 28 includes power switch 32 which is so positioned atop air motor 28 to be depressed upon closure of lid 16. Latches 34 such as the one shown in FIG. 1 hold lid 16 closed. Two or three such latches are preferred.

A lower portion of air motor 28 comprises a transmission 36 to reduce the motor's output speed. The construction of transmission 36, including its reduction gearing, is within the ordinary skill in the art. And, in some cases a transmission may be unnecessary, as where the air pressure available from air conduit 24 and the efficiency of air motor 26 produce a speed of rotation suited to the desired application.

A rigid drive shaft 38 is coupled to transmission 36 and extends downward therefrom where it is, in turn, coupled to submersible rotary pump 40. Thus, motor 26 and drive shaft 38 constitute the means for driving pump 40. Coupling of drive shaft 38 to transmission 36's output shaft (not shown), and to rotary pump 40's input shaft, may be effected, for example, by a mechanism such as coupling sleeve 42. Drive shaft 38 is preferably constructed of steel and of sufficient length to cause pump 40 to be positioned slightly above tank bottom 14.

Drive shaft 38 resides within drive shaft housing 44. Drive shaft housing 44 is an elongate, rigid tube, preferably of steel, having a first flattened collar 46 at its upper end and a second flattened collar 48 at its lower end. Collars 46 and 48 are integrally bound to their respective ends of drive shaft housing 44 as by welding. Upper collar 46 is affixed, as with screws 50, to the surface of air motor 26 surrounding its output shaft (not shown). Likewise, lower collar 48 is bound to the surface of rotary pump 40 surrounding its input shaft. Thus, drive shaft housing 44's overall length, including its collars, approximates the distance between the opposing faces of air motor 26 and rotary pump 40.

Figure 3:
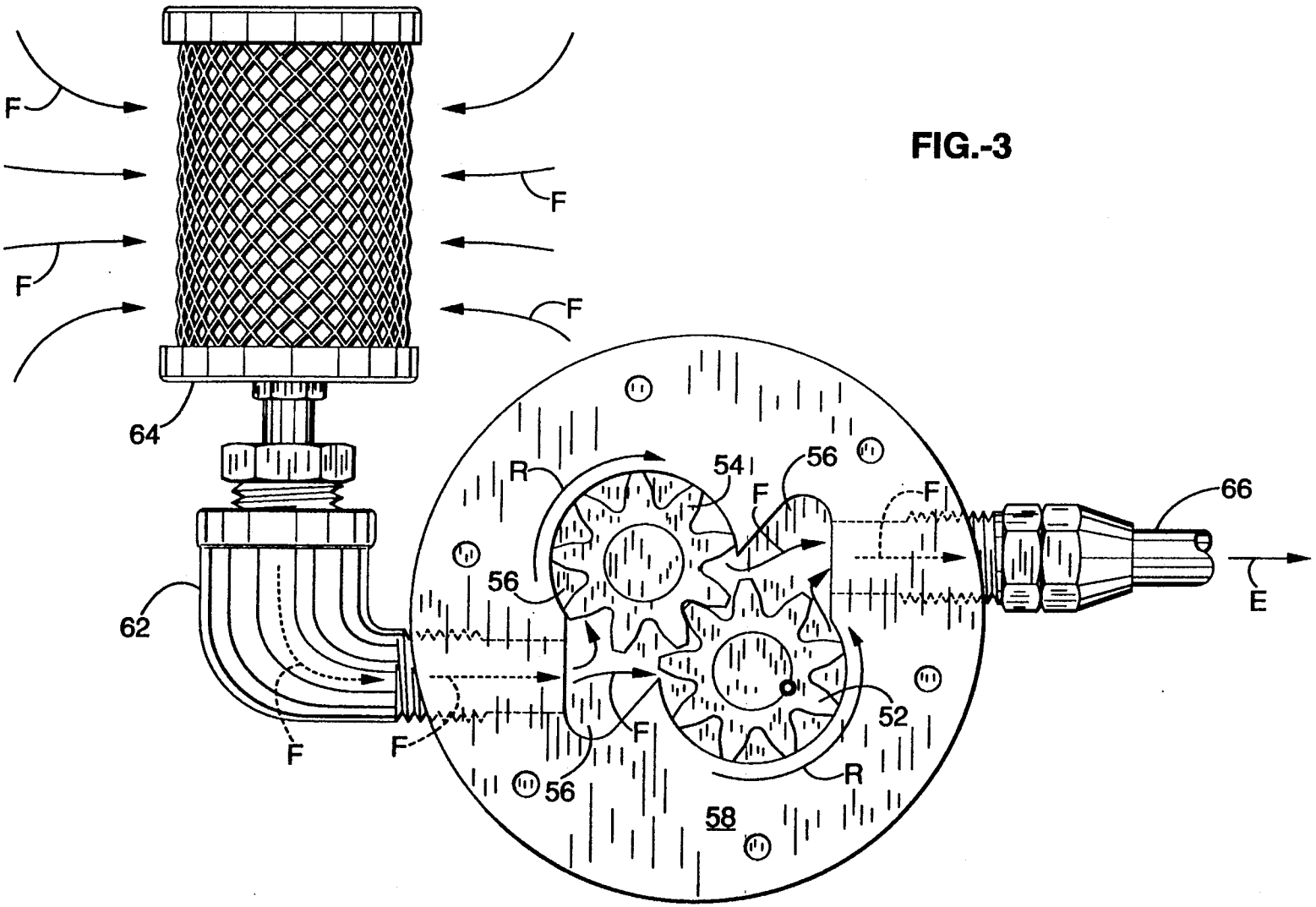
FIG. 3 is a bottom plan view of the pump body with its cover removed revealing gear wheels in the pump's flow chamber.

Rotary pump 40 is preferably that type of notoriously durable pump commonly referred to as a gear pump. Pump 40's input shaft is connected to first gear wheel 52, the teeth of which, in turn, are in intermeshing relation with the teeth of second gear wheel 54 within flow chamber 56 of pump body 58. These elements, and their interrelation, are shown in FIG. 3.

Pump body 58 is preferably a milled or cast unitary block. Pump cover plate 60 is affixed to pump body 58 and is oriented on the underside of pump 40. Screws, or the like (not shown), are preferably employed to affix cover plate 60 to pump body 58.

Gear wheels 54 and 56 may be constructed of any conventional rigid gear material, although plastics such as nylon, teflon or the like are preferred. Naturally, the properties of the intended cleaning fluid or solvent should be taken into account in choosing a gear material. And, appropriate shafts and bearings for true and long-wearing rotation of gear wheels 54 and 56 are necessary. The construction, composition and placement of such shafts and bearings are within the skill of those working in the art. Overall, pump 40 should be so constructed as to be submersible in the cleaning fluid or solvent needed for the specific application for which tank 10 will be used, and to yield a satisfactory service life in that environment.

Pump intake fluid conduit 62 projects from one side of rotary pump 40 and has filter 64 attached thereto with appropriate hardware (unnumbered). Intake conduit 62 preferably resides at the same general depth in cleaning tank 10 as pump 40. Filter 64 herein is of a cylindrical configuration, although many different filter configurations may work well in practicing the invention. Indeed, different applications and different fluids, solvents or cleaning solutions, as well as the nature of the debris to be filtered out, may dictate that specific filter constructions be employed.

An outflow fluid conduit 66 projects from the opposite side of pump 40, this too being attached to pump 40 with appropriate hardware (unnumbered). Outflow conduit 66 is preferably round in cross-section to facilitate its being connected to pump 40 with conventional hardware. Outflow conduit 6 is integrally bound to, and in fluid communication with, riser tube 68. Riser tube 68 and the below-described down-stream conduits to which it is attached have a square cross-section, the benefit of which is discussed below. In an alternative construction, outflow conduit 66 may be a length of flexible high-pressure, metal weave hose having coupling hardware on both ends for mating with complementary hardware on pump 40 and riser tube 68.

As shown in FIG. 1, riser tube 68 is integrally bound to, and in fluid communication with, circular manifold 70 which is supported in a generally horizontal orientation adjacent upper rim 18 by hooks 72. Hooks 72 are permanently affixed, as by spot welding, to the upper inside surface of tank 10's side wall 12. Several down-tubes 74 depend from manifold 70, and are spaced from one-another around manifold 70's arc. Down-tubes are generally vertically oriented and lie close to the inside surface of tank 10's side wall 12. They preferably terminate some distance above tank 10's bottom 14.

Joints between riser tube 68, manifold 70 and down-tubes 74 are preferably welded.

Riser tube 68, manifold 70 and down-tubes 74 make up a system of conduits for transporting solvent to several nozzles 76. Nozzles 76 are fittings with restricted openings and act as outlets to the conduit system, thus delivering solvent fluid as a fine spray to the interior of tank 10 for cleaning workpieces. As the inventive concepts herein may be employed to construct cleaning tanks to accommodate workpieces of different types, it should be understood that down-tubes 74 may be configured, and nozzles 76 may be placed, as needed. For example, right angles 78 or other turns may be incorporated into down-tubes to deliver spray from nozzles 76 in a specific direction. Further, one or more support bars 80, or support straps 82, may be employed to hold workpieces in place for cleaning. Such support bars and straps have been found to be most easily affixed to the surface of square tubing; thus, it is preferred for construction of the down-tubes as well as for the manifold and riser tube, as noted above.

The foregoing combination of variable spray and support elements permits fluid to be directed generally into the central space within tank 10, or more specifically at the outside, or into the interior of, a soiled workpiece.

Of course, appropriate seals are necessary throughout the system from the filter to the pump, to the fluid conduit couplings and to the nozzles. The placement of these seals is within the ordinary skill in the art and, naturally, the fluid's composition should be taken into account in choosing the materials of which these seals must be made.

It will be clear from the above discussion, and especially from examining FIG. 1, that the entire driving mechanism, the entire pumping mechanism, the entire fluid-delivering mechanism and all workpiece support structures of the inventive cleaning tank are suspended within tank 10, hanging freely from hooks 72 and the points where air motor 26 is bound to tank 10's side wall 12 at the input and outlet of air motor 26. It is preferable that neither pump 40 nor any other structures such as down-tubes rest on tank bottom 14. Neither should any structure be attached to tank 10's lower sides or bottom. In this way leaks are minimized.

In describing one possible use of cleaning tank 10, a paint spray gun will herein be used as an example of a typical workpiece. As shown in FIG. 1, the gun head 84 is hung on support bar 80 with its intake tube over a nozzle. Other nozzles are directed at the side of the gun head and into the general area above the gun head. Paint gun container 86 is held in an inverted orientation on support strap 82, with a nozzle directed into its interior and others directed at its surface and into the general area above it.

Either before or after the workpieces are in place, a volume of fluid, (in this case paint thinner or a like solvent) is introduced to tank 10. The depth of the solvent should be sufficient to cover filter 64 when the air motor 26 and pump 40 are in operation. Next, lid 16 is closed and secured with latches 34. This closing of the lid depresses power switch 32 and permits pressurized air to flow through air motor 26. As air motor 26 operates, its rotational motion is passed through drive shaft 38 to pump 40. First gear wheel 52 rotates within pump chamber 56, its teeth meshing with those of second gear wheel 54 causing gear wheel 54 to rotate in the opposite direction. As shown by directional arrows in FIG. 3, (F = flow direction of solvent; R = rotation direction of gear wheels; and, E exit direction of solvent) this action draws solvent into the upstream side of flow chamber 56 where its flow is split in two directions and drawn in pockets between teeth of one or the other gear wheel past closely-fitting arcuate chamber walls and dumped into the downstream side of the flow chamber. The fluid pressure created here depends, of course, on the speed of the pump. And the speed of the pump, in turn, depends on the amount of air pressure, at air input 22, turning air motor 26. Different fluid pressure needs may be met by substituting one air motor for another, or by adjusting the air input pressure, the gearing in the transmission or the bore sizes used in the conduit system. These adjustments and substitutions are within the ordinary skill in the art.

Solvent travels under pressure through outflow conduit 66, up riser tube 68, through manifold 70 in both directions, through down-tubes 74 and out of nozzles 76 as a spray. Solvent is delivered to the interior and exterior of the workpieces by nozzles at close range. Nozzles placed higher up in the tank emit spray over a larger area to help sweep debris downward. All of the foregoing is conducted automatically once lid 16 is closed, and continues until the lid is opened or until air pressure is no longer delivered to air input 22. Thus, the foregoing configuration of the apparatus, as it is especially adapted in this embodiment to cleaning a paint spray gun, makes it "automatic" in that the user needs merely to place the parts of the gun in the proper orientation within the tank and close the lid. Solvent is directed to the inside and outside surfaces of the gun's parts so that, in sufficient time, the gun is again ready for use with no additional attention to cleaning being necessary.

Debris is collected in the pool of solvent at the bottom of the tank and is kept from recycling by filter 64. Any leaks from the conduit system drip back into the tank, thereby avoiding any mess or hazard.

Once contaminated beyond a desired limit, the tank's solvent is easily removed by tipping the tank and pouring it out. If a more thorough cleaning of the tank is necessary, or if any of the tank's mechanisms needs repair, air motor 26 may simply be detached from side wall 12 permitting all the invention's working components to be lifted out and serviced.

The foregoing detailed disclosure of the inventive cleaning tank 10 is considered as only illustrative of the preferred embodiment of, and not a limitation upon the scope of, the invention. Those skilled in the art will envision many other possible variations of the structure disclosed herein that nevertheless fall within the scope of the following claims. For example, to suit one's needs, one may alter the size and specifications of the tank, the air motor and its working air pressure, the transmission, the pump capacity and the configuration of the conduits, nozzles, and supports to accommodate any conceivable workpiece. The composition of the invention's components, including seals and the like, may be chosen to be resistant to the types of fluids, solvents or cleaning solutions desired. And, alternative uses for this inventive cleaning tank may later be realized. Of course the value of tank 10 for cleaning tools and parts in the industrial arts is easy to envision. But, various surface treatments may also be carried out with this inventive apparatus. The invention finds potential application in any arts where fluid must be applied to the surface of a workpiece. And, medical and other applications may also be practical—for example, in the operating room environment where flammable vapors and gasses are common. Of course, in that case the fluids employed may need to be active against biological contaminants. Accordingly, the scope of the invention should be determined with reference to the appended claims, and not by the examples which have herein been given.

I claim:

1. Apparatus for applying fluid to a workpiece, comprising:

a. a fluid container;

b. a submersible pump within said fluid container;

c. means for driving said pump;

d. outlet means within said fluid container for directing fluid at a workpiece; and, e. conduit means disposed between, and in fluid communication with, said pump and said outlet means for directing fluid to said outlet means, said submersible pump, said driving means, said outlet means and said conduit means being suspended within, and above a bottom surface of, said fluid container.

2. The apparatus of claim 1, wherein said means for driving said pump is mounted within said fluid container.

3. The apparatus of claim 1, wherein said fluid container has a lid and said lid is adapted to trip a power switch, thereby to activate said driving means upon said lid's closure.

4. The apparatus of claim 3, wherein said lid of said fluid container is a hinged lid.

5. The apparatus of claim 1, wherein said submersible pump is a rotary pump.

6. The apparatus of claim 1, wherein said submersible pump is a gear pump.

7. The apparatus of claim 1, wherein said submersible pump is disposed adjacent a bottom surface of said fluid container.

8. The apparatus of claim 1, wherein said means for driving said pump comprises an air motor.

9. The apparatus of claim 8, wherein said air motor is disposed adjacent an upper opening of said fluid container and includes a power switch operable by contact with a lid on said fluid container.

10. The apparatus of claim 6, wherein said submersible pump is driven by a drive shaft between said air motor and said submersible pump.

11. The apparatus of claim 1, wherein said conduit means includes a riser-tube for directing fluid from said submersible pump to a manifold disposed above said pump.

12. The apparatus of claim 1, wherein said conduit means includes a manifold having a generally circular shape.

13. The apparatus of claim 1, wherein said conduit means includes a manifold supported adjacent to an upper opening of said fluid container.

14. The apparatus of claim 13, wherein said manifold is supported by a plurality of hooks, said hooks being affixed adjacent to said upper opening of said fluid container.

15. The apparatus of claim 1, wherein said conduit means includes a plurality of down-tubes projecting downward from a manifold.

16. The apparatus of claim 1, wherein said outlet means comprises at least on nozzle able to transform fluid under pressure within said conduit means to a spray.

17. The apparatus of claim 1, wherein at least one support for a workpiece is provided within said fluid container.

18. The apparatus of claim 17, wherein at least one said support protrudes from a down-tube, and wherein said down-tube, in turn, projects downward from a manifold supported adjacent to an upper opening of said fluid container.

19. The apparatus of claim 17, wherein at least one said support is adapted to hold a workpiece in a position which permits fluid to be directed upon an outer surface of said workpiece by said outlet means.

20. The apparatus of claim 17, wherein at least one said support is adapted to hold a workpiece in a position which permits fluid to be directed into the interior of said workpiece by said outlet means.

21. Apparatus for applying fluid to a workpiece, comprising:

a. a fluid container having an upper opening and a lid thereover;

b. a submersible pump within said fluid container;

c. means for driving said pump, said means comprising an air motor disposed adjacent said upper opening of said fluid container, said motor including a power switch operable by contact with said fluid container's lid;

d. outlet means within said fluid container for directing fluid at a workpiece; and, e. conduit means disposed between, and in fluid communication with, said pump and said outlet means for directing fluid to said outlet means.

22. The apparatus of claim 21, wherein said submersible pump, said driving means, said outlet means and said conduit means are suspended within, and above a bottom surface of said fluid container.

23. The apparatus of claim 21, wherein said lid of said fluid container is a hinged lid.

24. The apparatus of claim 21, wherein said submersible pump is a rotary pump.

25. The apparatus of claim 21, wherein said submersible pump is a gear pump.

26. The apparatus of claim 21, wherein said submersible pump is disposed adjacent a bottom surface of said fluid container.

27. The apparatus of claim 21, wherein said submersible pump is driven by a drive shaft between said air motor and said submersible pump.

28. The apparatus of claim 21, wherein said conduit means includes a riser-tube for directing fluid from said submersible pump to a manifold disposed above said pump.

29. The apparatus of claim 21, wherein said conduit means includes a manifold having a generally circular shape.

30. The apparatus of claim 21, wherein said conduit means includes a manifold supported adjacent to an upper opening of said fluid container.

31. The apparatus of claim 30, wherein said manifold is supported by a plurality of hooks, said hooks being affixed adjacent to said upper opening of said fluid container.

32. The apparatus of claim 21, wherein said conduit means includes a plurality of down-tubes projecting downward from a manifold.

33. The apparatus of claim 21, wherein said outlet means comprises at least one nozzle able to transform fluid under pressure within said conduit means to a spray.

34. The apparatus of claim 21, wherein at least one support for a workpiece is provided within said fluid container.

35. The apparatus of claim 34, wherein at least one said support protrudes from a down-tube, and wherein said down-tube, in turn, projects downward from a manifold supported adjacent to an upper opening of said fluid container.

36. The apparatus of claim 34, wherein at least one said support is adapted to hold a workpiece in a position which permits fluid to be directed upon an outer surface of said workpiece by said outlet means.

37. The apparatus of claim 34, wherein at least one said support is adapted to hold a workpiece in a position which permits fluid to be directed into the interior of said workpiece by said outlet means.

38. Apparatus for applying fluid to a workpiece, comprising:

a. a fluid container;
b. a submersible pump within said fluid container;
c. means for driving said pump;
d. outlet means within said fluid container for directing fluid at a workpiece;
e. conduit means disposed between, and in fluid communication with, said pump and said outlet means for directing fluid to said outlet means;
f. a manifold included in said conduit means; and,
g. a plurality of hooks affixed adjacent to an upper opening of said fluid container and supporting said manifold adjacent to said opening.

39. The apparatus of claim 38, wherein said means for driving said pump is mounted within said fluid container.

40. The apparatus of claim 38, wherein said submersible pump, said driving means, said outlet means and said conduit means are suspended within, and above a bottom surface of said fluid container.

41. The apparatus of claim 38, wherein said fluid container has a lid and said lid is adapted to trip a power switch, thereby to activate said driving means upon said lid's closure.

42. The apparatus of claim 41, wherein said lid of said fluid container is a hinged lid.

43. The apparatus of claim 38, wherein said submersible pump is a rotary pump.

44. The apparatus of claim 38, wherein said submersible pump is a gear pump.

45. The apparatus of claim 38, wherein said submersible pump is disposed adjacent a bottom surface of said fluid container.

46. The apparatus of claim 38, wherein said means for driving said pump comprises an air motor.

47. The apparatus of claim 46, wherein said air motor is disposed adjacent an upper opening of said fluid container and includes a power switch operable by contact with a lid on said fluid container.

48. The apparatus of claim 46, wherein said submersible pump is driven by a drive shaft between said air motor and said submersible pump.

49. The apparatus of claim 38, wherein said conduit means includes a riser-tube for directing fluid from said submersible pump to a manifold disposed above said pump.

50. The apparatus of claim 38, wherein said conduit means includes a manifold having a generally circular shape.

51. The apparatus of claim 38, wherein said conduit means includes a plurality of down-tubes projecting downward from a manifold.

52. The apparatus of claim 38, wherein said outlet means comprises at least one nozzle able to transform fluid under pressure within said conduit means to a spray.

53. The apparatus of claim 38, wherein at least one support for a workpiece is provided within said fluid container.

54. The apparatus of claim 53, wherein at least one said support protrudes from a down-tube, and wherein said down-tube, in turn, projects downward from a manifold supported adjacent to an upper opening of said fluid container.

55. The apparatus of claim 53, wherein at least one said support is adapted to hold a workpiece in a position which permits fluid to be directed upon an outer surface of said workpiece by said outlet means.

56. The apparatus of claim 53, wherein at least one said support is adapted to hold a workpiece in a position which permits fluid to be directed into the interior of said workpiece by said outlet means.

57. Apparatus for applying fluid to a workpiece, comprising:

a. a fluid container;
b. a submersible pump within said fluid container;
c. means for driving said pump;
d. outlet means within said fluid container for directing fluid at a workpiece;
e. conduit means disposed between, and in fluid communication with, said pump and said outlet means for directing fluid to said outlet means;
f. a manifold supported adjacent to an upper opening of said fluid container;
g. at least one down-tube projecting downward from said manifold; and,
h. a workpiece support protruding from at least one said down-tube.

58. The apparatus of claim 57, wherein said means for driving said pump is mounted within said fluid container.

59. The apparatus of claim 57, wherein said submersible pump, said driving means, said outlet means and said conduit means are suspended within, and above a bottom surface of said fluid container.

60. The apparatus of claim 57, wherein said fluid container has a lid and said lid is adapted to trip a power switch, thereby to activate said driving means upon said lid's closure.

61. The apparatus of claim 60, wherein said lid of said fluid container is a hinged lid.

62. The apparatus of claim 57, wherein said submersible pump is a rotary pump.

63. The apparatus of claim 57, wherein said submersible pump is a gear pump.

64. The apparatus of claim 57, wherein said submersible pump is disposed adjacent a bottom surface of said fluid container.

65. The apparatus of claim 57, wherein said means for driving said pump comprises an air motor.

66. The apparatus of claim 65, wherein said air motor is disposed adjacent an upper opening of said fluid container and includes a power switch operable by contact with a lid on said fluid container.

67. The apparatus of claim 65, wherein said submersible pump is driven by a drive shaft between said air motor and said submersible pump.

68. The apparatus of claim 57, wherein said conduit means includes a riser-tube for directing fluid from said submersible pump to a manifold disposed above said pump.

69. The apparatus of claim 57, wherein said conduit means includes a manifold having a generally circular shape.

70. The apparatus of claim 57, wherein said conduit means includes a manifold supported adjacent to an upper opening of said fluid container.

71. The apparatus of claim 70, wherein said manifold is supported by a plurality of hooks, said hooks being affixed adjacent to said upper opening of said fluid container.

72. The apparatus of claim 57, wherein said conduit means includes a plurality of down-tubes projecting downward from a manifold.

73. The apparatus of claim 57, wherein said outlet means comprises at least one nozzle able to transform fluid under pressure within said conduit means to a spray.

74. The apparatus of claim 57, further including at least one support adapted to hold a workpiece in a position which permits fluid to be directed upon an outer surface of said workpiece by said outlet means.

75. The apparatus of claim 57, further including at least one support adapted to hold a workpiece in a position which permits fluid to be directed into the interior of said workpiece by said outlet means.

76. A pain gun cleaning tank, comprising:

a. a fluid container;

b. a submersible pump within said fluid container;

c. means for driving said pump mounted within said fluid container;

d. first outlet means within said fluid container for directing fluid to a paint gun's spray head;

e. second outlet means within said fluid container for directing fluid to a paint gun's paint container; and, f. conduit means disposed between, and in fluid communication with, said pump and said outlet means for directing fluid to said outlet means, said submersible pump, said driving means, said outlet means and said conduit means being suspended within, and above a bottom surface of, said fluid container.

77. An automatic cleaning tank for a paint spray gun, comprising:

a. a solvent container;

b. a submersible gear pump within said fluid container;

c. rotary means for driving said pump mounted within said container;

d. first outlet means within said solvent container for directing solvent to the interior of a paint gun's spray head;

e. second outlet means within said solvent container for directing solvent to the exterior of a paint gun's spray head;

f. third outlet means within said solvent container for directing solvent to the interior of a paint gun's container;

g. fourth outlet means within said solvent container for directing solvent to the exterior of a paint gun's paint container;

h. at least one nozzle included in each of said outlet means, said nozzles being for delivering solvent as a spray;

i. conduit means disposed between, and in fluid communication with, said pump and said outlet means for directing solvent to said outlet means;

j. a manifold included in said conduit means, said manifold having a generally circular shape; and, k. a plurality of down-tubes depending from said manifold.

78. An automatic cleaning tank for a paint spray gun, comprising:

a. a solvent container:

b. a submersible gear pump within said fluid container;

c. rotary means for driving said pump mounted within said container;

d. first outlet means within said solvent container for directing solvent to the interior of a paint gun's spray head;

e. second outlet means within said solvent container for directing solvent to the exterior of a paint gun's spray head;

f. third outlet means within said solvent container for directing solvent to the interior of a paint gun's container;

g. fourth outlet means within said solvent container for directing solvent to the exterior of a paint gun's paint container; and, h. conduit means disposed between, and in fluid communication with, said pump and said outlet means for directing fluid to said outlet means and said conduit means being suspended within, and above a bottom surface of, said fluid container.

79. Apparatus for applying fluid to a workpiece, comprising:

a. a fluid container having a bottom surface and an upper, inner surface;

b. at least one support affixed to said upper, inner surface;

c. means within said container for pressurizing fluid, said pressurizing means being suspended upon said support within, and above said bottom surface of, said container;

d. fluid conduit means disposed within said fluid container and in fluid communication with said pressurizing means, said fluid conduit means further being suspended upon said support within, and above said bottom surface of, said container;

e. outlet means for directing fluid at a workpiece, said outlet means being in fluid communication with said fluid conduit means, said outlet means further being suspended upon said support within, and above said bottom surface of, said container; and, f. a power supply conduit to said pressurizing means, wherein said power supply conduit passes through a wall of said container above all elements of which said fluid conduit means and said outlet means are comprised, and wherein except for any outlet in communication with and closely adjacent to said power supply, said container's walls are otherwise devoid of other structures passing therethrough.

* * * * *